United States Patent [19]

Cochrane et al.

[11] Patent Number: 4,874,465

[45] Date of Patent: Oct. 17, 1989

[54] TISSUE PRODUCTS CONTAINING SLICED FIBERS

[75] Inventors: Faith E. Cochrane; Michael J. Smith, both of Neenah; John D. Litvay, Appleton, all of Wis.

[73] Assignee: Kimberly-Clark Corporation, Neenah, Wis.

[21] Appl. No.: 173,961

[22] Filed: Mar. 28, 1988

[51] Int. Cl.[4] ..... D21H 5/24

[52] U.S. Cl. ..... 162/111; 162/1; 162/9; 162/100; 162/141; 162/142; 162/150

[58] Field of Search ..... 162/1, 9, 100, 111, 162/141, 150, 142

[56] References Cited

U.S. PATENT DOCUMENTS 2,735,762 2/1956 Clark ..... 162/1
3,821,068 6/1974 Shaw ..... 162/111
4,166,001 8/1979 Dunning et al. ..... 162/111

FOREIGN PATENT DOCUMENTS 664031 5/1963 Canada .

OTHER PUBLICATIONS

Green et al., "The Effect of Chipping on the Suitability of Wood for Sulphite Pulping," *Pulp and Paper Canada,* Convention Issue 1940, pp. 123–126.

*Primary Examiner*—Peter Chin
*Attorney, Agent, or Firm*—Gregory E. Croft

[57] ABSTRACT

Tissue products, such as facial and bath tissue, are provided with improved softwood and opacity by making the products from a furnish containing fibers of a lower coarseness created by splitting the fibers in the lengthwise direction.

5 Claims, No Drawings

TISSUE PRODUCTS CONTAINING SLICED FIBERS

BACKGROUND OF THE INVENTION

In the manufacture of tissue products, such as facial tissue and bath tissue, constant attention has been given to ways to improve softness of the product as perceived by the consumer. For example, it has long been known that the use of Eucalyptus fibers improves the perceived softness of tissue products and such fibers have been incorporated into commercially available products for years. Other efforts to improve softness have focused on the creping step and the attendant adhesion of the uncreped web to the creping cylinder. Layering has also received considerable attention, particularly by placing the Eucalyptus fibers in the outer layers to maximize the tactile response. All of these approaches have their place in improving the perceived softness of tissue products, but there are other factors to consider which, until now, have not been fully appreciated.

SUMMARY OF THE INVENTION

The invention resides in the use of sliced fibers for the manufacture of tissue products. It has been discovered that a key to achieving improved softness in tissue products lies in the Coarseness Index of the fibers used to form the product. The Coarseness Index for any given species of fiber or any fiber furnish is the weight per unit length of fiber (e.g. milligrams per 100 meters) and is defined as follows:

$$\text{Coarseness Index} = \sqrt{\frac{100}{(F/G)(L)}}$$

where $(F/G)$ = millions of fibers per gram of fiber; and $(L)$ = the numerical average length of the fibers in millimeters.

To fully understand the meaning of the Coarseness Index, it is important to distinguish coarseness from slenderness, which is a different parameter. Fiber slenderness is the ratio of fiber length to fiber diameter. This concept does not take into account the density of the fiber material or the thickness of the fiber wall for hollow fibers. Hence two fibers of the same length and outside diameter, but differing in wall thickness, will have the same slenderness but different coarsenesses. At the same time, a very long fiber having a thick diameter may have a high slenderness but may also have a high coarseness. The difference between coarseness and slenderness can be significant and can be the difference between a soft sheet and a stiff sheet. It is also important to note that coarseness is not directly a function of fiber length. A fiber having a given Coarseness Index will still have the same Coarseness Index after being shortened because the fibers per gram of fiber will be increased in the same proportion as the length reduction, thereby netting no change. This of course is not the case with slenderness, in which case the slenderness of the fiber is reduced in proportion to the length reduction.

With the foregoing in mind, it has now been discovered that fiber species having a high Coarseness Index (therefore imparting a relatively low softness to a tissue product) can be sliced lengthwise to decrease the Coarseness Index of the fibers used in the tissuemaking furnish. As a result, the softness of the tissue product made with the sliced fibers is softer than the tissue product made with the natural or original fibers. The fibers to be split can be woody fibers, nonwoody fibers, or synthetics. For purposes herein, the term "sliced fibers" means fibers that have been cut generally lengthwise, as contrasted with fibers which have been cut crosswise. Ideally, sliced fibers have not been reduced in fiber length relative to the original fibers. However, as a practical matter, fiber shortening is difficult or impossible to avoid from a process standpoint. The amount of sliced fibers in a tissue product necessary to exhibit a measurable softness benefit is believed to be about five (5) weight percent. For purposes of this invention, the amount of sliced fibers can be from about 5 to 100 weight percent of the fiber content of the tissue product.

For purposes herein, "tissue product" means a product having one or more fibrous sheets, preferably creped, each sheet having a dry basis weight of from about 5 to about 40 pounds per 2880 square feet, preferably from about 5 to about 25 pounds per 2880 square feet, and most preferably from about 5 to about 10 pounds per 2880 square feet. Bulk densities for tissue products are typically less than about 0.20 grams per cubic centimeter and often are less than about 0.15 grams per cubic centimeter. Products such as facial tissue, bath tissue, paper towels, and dinner napkins are specific examples of tissue products within the meaning of this invention.

DETAILED DESCRIPTION OF THE INVENTION

Twenty-year-old disks of southern yellow pine (one inch thick) were cut to provide blocks containing the last ten years of growth. Block size was approximately 4 inches×4 inches. Each block was radially cut in half to provide two mirror image samples of each block, one to be used for fiber slicing in accordance with this invention and the other to be used as a control. Each sample was soaked in water for several days to achieve complete swelling and ease the subsequent slicing process. One of the two samples from each block was sliced with a sliding microtome (A. O. Spencer Model 860, Gaithersburg, MD) in a direction parallel to the radial direction of the original wood disk. The microtome was set to cut slices every 15 micrometers. The control samples from each block were cut into toothpick-size chips. Both the sliced and the chipped wood were pulped to equivalent yields with a standard kraft cook in a small-scale, oil-heated laboratory digester and made into handsheets for analysis.

Average fiber length for each sample (reported in millimeters) was determined using a commercially available instrument (Kajaani Model FS-100 available from Kajaani Automation, Inc., Norcross, Georgia). While this particular instrument is highly sophisticated, average fiber length can be determined by other means as those familiar with fiber measurements will appreciate. Tensile strength (dry) and elastic modulus were determined with a Model 1130 Instron, including a recorder and Microcon 1 along with Modulus and Yield Option and stackable speed reducer, available from, Instron Corporation, Canton, Massachusetts. Test samples of handsheets had a basis weight of about 24–25 pounds per 2880 square feet and were cut to a width of one inch. Tensile strength measurements are reported in grams. Modulus is reported in kilometers (modulus/-

(sample width)(basis weight)). Opacity (Tappi) was measured by using an opacimeter which measures the ratio of light reflected from a paper sample when the sample is backed by a perfectly black body to that when the sample is backed by a white body of 89% reflectance.

The results of pulping the sliced and chipped samples are summarized in Table 1 below.

TABLE 1

| Sample | Pulp Yield (%) | Average Fiber Length | Fibers per Gram ($\times 10^6$) | Coarseness Index |
|---|---|---|---|---|
| Chipped | 50 | 3.6 | 0.85 | 33.2 |
| Sliced | 52 | 0.8 | 6.83 | 18.1 |

The results clearly show the effectiveness of fiber slicing as a means to lower the Coarseness Index. At the same time, however, the average fiber length was also substantially reduced due to cross-directional cutting of fibers within the sample blocks. Nevertheless, fiber shortening was simultaneously counteracted by an increase in the number of fibers per gram. The net result was a reduction in the Coarseness Index of from 33.2 to 18.1.

Table 2 shows the results of forming chipped and sliced kraft pulp fibers into handsheets, which was carried out in a conventional manner well known to those skilled in the papermaking arts. The properties of the resulting handsheets are set forth below.

TABLE 2

| Sample | Pulp Yield (%) | Tensile | Modulus | Tensile/ Modulus | Opacity |
|---|---|---|---|---|---|
| 1 (Chipped) | 68 | 102 | 9.7 | 109 | 79.4 |

TABLE 2-continued

| Sample | Pulp Yield (%) | Tensile | Modulus | Tensile/ Modulus | Opacity |
|---|---|---|---|---|---|
| 2 (Sliced) | 72 | 148 | 8.8 | 174 | 82.3 |
| 3 (Chipped) | 56 | 321 | 22.8 | 146 | 86.2 |
| 4 (Sliced) | 60 | 328 | 20.9 | 163 | 88.1 |
| 5 (Chipped) | 49 | 474 | 31.7 | 156 | 63.3 |
| 6 (Sliced) | 50 | 833 | 39.7 | 218 | 71.8 |

The results set forth in Table 2 illustrate that in each case the sliced fibers increase the tensile/modulus ratio. This ratio is a measure of the sheet flexibility and hence softness. Hence the sliced fibers improved the softness of the sheet. They also improved the opacity of the sheet, which is also desirable for purposes of consumer preference.

It will be appreciated that the foregoing examples, shown for purposes of illustration, are not to be construed as limiting the scope of this invention, which is defined by the following claims.

We claim:

1. A tissue product comprising a fibrous sheet having a dry basis weight of from about 5 to about 40 pounds per 2880 square feet and having a bulk density of less than about 0.20 grams per cubic centimeter, said sheet comprising from about 5 to 100 weight percent lengthwise-sliced individual fibers based on the total fiber content of the product, said lengthwise-sliced fibers exhibiting a substantially reduced Coarseness Index.

2. The product of claim 1 wherein the fibers are natural fibers.

3. The product of claim 1 wherein the fibers are woody fibers.

4. The product of claim 1 wherein the fibers are softwood fibers.

5. The product of claim 1 wherein the fibers are southern pine fibers.

* * * * *

UNITED STATES PATENT AND TRADEMARK OFFICE

CERTIFICATE OF CORRECTION

PATENT NO. : 4,874,465

DATED : October 17, 1989

INVENTOR(S) : F. E. Cochrane et al.

It is certified that error appears in the above-identified patent and that said Letters Patent is hereby corrected as shown below:

In the Abstract, line two, delete "softwood" and substitute therefor --softness--.

Column 1, line 35, delete the square root symbol.

Signed and Sealed this

Ninth Day of October, 1990

*Attest:*

HARRY F. MANBECK, JR.

*Attesting Officer*

*Commissioner of Patents and Trademarks*